US005755024A

United States Patent [19]

Drake et al.

[11] Patent Number: 5,755,024

[45] Date of Patent: May 26, 1998

[54] PRINTHEAD ELEMENT BUTTING

[75] Inventors: Donald J. Drake, Rochester; Mark A. Cellura, Fairport, both of N.Y.; Hung C. Nguyen, Buena Park, Calif.

[73] Assignee: Xerox Corporation, Stamford, Conn.

[21] Appl. No.: 573,733

[22] Filed: Dec. 18, 1995

Related U.S. Application Data

[62] Division of Ser. No. 155,366, Nov. 22, 1993, abandoned.

[51] Int. Cl.[6] ..... H05B 3/00

[52] U.S. Cl. ..... 29/611; 29/890.1; 29/414; 347/42

[58] Field of Search ..... 29/611, 890.1, 29/412, 413, 414, 415; 347/20, 42, 49, 63

[56] References Cited

U.S. PATENT DOCUMENTS

| | | | |
|---|---|---|---|
| Re. 32,572 | 1/1988 | Hawkins et al. | 156/626 |
| 4,463,359 | 7/1984 | Ayata et al. | 346/1.1 |
| 4,612,554 | 9/1986 | Poleshuk | 346/140 |
| 4,638,337 | 1/1987 | Torpey et al. | 346/140 |
| 4,678,529 | 7/1987 | Drake et al. | 156/234 |
| 4,774,530 | 9/1988 | Hawkins | 346/140 |
| 4,822,755 | 4/1989 | Hawkins et al. | 437/227 |
| 4,829,324 | 5/1989 | Drake et al. | 346/140 |
| 5,000,811 | 3/1991 | Campanelli | 156/264 |
| 5,010,355 | 4/1991 | Hawkins et al. | 346/140 |
| 5,041,190 | 8/1991 | Drake et al. | 156/647 |
| 5,079,189 | 1/1992 | Drake | 437/209 |
| 5,098,503 | 3/1992 | Drake | 156/299 |
| 5,160,403 | 11/1992 | Fisher et al. | 156/633 |
| 5,198,054 | 3/1993 | Drake et al. | 156/64 |
| 5,221,397 | 6/1993 | Nystrom | 156/273.5 |

*Primary Examiner*—P. W. Echols
*Attorney, Agent, or Firm*—Daniel J. Krieger

[57] ABSTRACT

A large array or pagewidth printhead fabricated from printhead elements or subunits. The printhead subunits are butted together at either adjacent channel elements or adjacent heater elements to form a pagewidth printhead. The butting element, either heater or channel element, is slightly wider than the non-butting element thereby providing gaps between the non-butting elements of a printhead element array. Where channel elements are used as the butting element, gaps between the heater elements provide for reduction or elimination of potentially damaging thermal compressive forces between adjacent heater elements. Where heater elements are used as the butting element, structural strength is increased since the heater wafer is stronger than the channel wafer. In addition, the width of the polyimide wall at the edges of the heater wafer is increased providing greater protection for thermal transducers located at the edges of individual heater elements.

9 Claims, 8 Drawing Sheets

PRINTHEAD ELEMENT BUTTING

This is a division of application Ser. No. 08/155,366, filed Nov. 22, 1993, now abandoned.

FIELD OF THE INVENTION

This invention relates generally to the fabrication of large array or pagewidth reading or writing bars, and more particularly to the fabrication process for a pagewidth linear array of reading or writing bars from subunits. By example, illustration of the specific details of the invention are provided for a pagewidth thermal ink jet printhead array fabricated from fully functional subunits.

BACKGROUND OF THE INVENTION

It is well known in the reading and/or writing bar industry to assemble pagewidth raster input scanning (RIS) and raster output scanning (ROS) bars from relatively short RIS/ROS subunits placed end-to-end. Once assembled, the pagewidth RIS/ROS bars or reading and writing bar arrays have the requisite length and number of image processing elements to scan or to write an entire line of information at once with a high image resolution. The subunits have either image reading arrays which comprise a succession of image sensing elements to convert the visual information into electrical signals or pixels, or image writing arrays which comprise a succession of ink producing or other elements employed to produce visual information in response to an electrical signal or pixel input.

In particular, thermal ink jet printing systems use thermal energy selectively produced by resistors or thermal transducers located in capillary filled ink channels near channel terminating nozzles or orifices to momentarily vaporize the ink and form bubbles on demand. Each temporary bubble expels an ink droplet and propels it towards a recording medium. The use of an array of printhead subunits is appropriate because large array or pagewidth printheads cannot be practically fabricated on a single wafer. Full width printbars composed of collinear arrays of thermal ink jet printhead elements subunits have a number of architectural advantages over staggered offset printbar architecture. One convenient method of fabricating a collinear subunit printbar is to simply butt each printhead element up against an adjacent printhead element. This fabrication method provides positive positioning of the printhead elements and minimizes the nozzle gap between adjacent printhead elements.

Various ink jet printheads and methods for fabricating ink jet printheads, and in particular large array ink jet printheads.

In U.S. Pat. No. 4,463,359 to Ayata et al., a drop on demand type ink jet recording method and apparatus which causes droplet emission from a small orifice is described. A drive signal is applied to the ink in a small liquid chamber to cause bubble formation in the ink which expels the ink from the orifice.

U.S. Pat. No. 4,612,554 to Poleshuk describes an ink jet printhead constructed of two identical parts. Identical V-grooved parts are mated face to face thereby interlocking lands containing heating elements and addressing electrodes so that the parts are automatically aligned with ink channels formed between the V-grooves on one part and the heating element containing land of the other part.

U.S. Pat. No. 4,638,337 to Torpey et al. describes an improved thermal ink jet printhead which prevents the sudden release of vaporized ink to the atmosphere, known as blowout, which causes ingestion of air and interrupts printhead operation.

U.S. Pat. No. 4,678,529 to Drake et al. describes a method of bonding thermal ink jet printhead components together by applying an adhesive to only higher surfaces of a substrate containing ink bearing structures, while all the surfaces of the ink bearing structures are free of adhesive.

U.S. Pat. No. Re. 32,572 to Hawkins et al. describes an ink jet printhead for high resolution printing made by concurrent fabrication of large quantities of printheads from two substrates that are preferably silicon wafers. A plurality of sets of bubble generating heating elements and their addressing electrodes are formed on one substrate and a corresponding plurality of sets of ink channels and their ink supplying manifolds are formed on another substrate.

U.S. Pat. No. 4,774,530 to Hawkins describes an ink jet printhead having electrode passivation and a means to provide an ink flow path between an ink manifold and individual ink channels by the placement of a thick film organic structure.

U.S. Pat. No. 4,822,755 to Hawkins et al. describes a method for forming large area arrays by butting together a plurality of integrated circuit chips. A wafer fabrication technique is modified to include a combination of orientation dependent etching and reactive ion etching steps to enable chip separation to be accomplished without the resulting chip edges or surface damage.

U.S. Pat. No. 4,829,324 to Drake et al. describes a large array thermal ink jet printhead and a fabrication process to provide precision assembly of the printhead using a subunit approach.

U.S. Pat. No. 5,000,811 to Campanelli et al. describes a fabrication approach for large array or pagewidth thermal ink jet printheads in which wafer subunits are diced precisely for alignment and subsequent fabrication.

U.S. Pat. No. 5,010,355 to Hawkins et al. describes a two part thermal ink jet printhead in which one part contains ink flow directing channels, nozzles, and ink supplying reservoir, and the other part contains heating elements and ionic passivation of electronic driving circuitry.

U.S. Pat. No. 5,041,190 to Drake et al. describes a method of fabricating channel plates and ink jet printheads containing channel plates. The channel plates are formed with etch openings defining side edges of the channel plate on one side of channel plate and etch openings defining the locations and dimensions of channel grooves and ink fill holes on the opposite side of the channel plate.

U.S. Pat. No. 5,160,403 to Fisher et al. describes methods of fabricating ink jet printheads which can be butted against an aligning substrate to form an extended staggered array printhead.

U.S. Pat. No. 5,198,054 to Drake et al. describes a fabrication process that will permit precision assembly of large arrays of reading and/or writing bars and thermal ink jet printheads.

U.S. Pat. No. 5,221,397 to Nystrom describes a large array fabrication process for assembly of large arrays of reading and/or writing bars from fully functional subunits, such as thermal ink jet printheads, a means to anchor the subunits to a structural bar in a temporary fashion.

One significant drawback to butted arrays of collinear printheads is thermal expansion at the butting edges of adjacent printhead elements in the location of the thermal transducers. In addition, printhead elements fabricated from mated wafers meets at two butting surfaces and consequently any butting errors are the result of either one of the wafers or both wafers.

SUMMARY OF THE INVENTION

In accordance with one aspect of the present invention, there is provided a printhead element for use in a large array ink jet printhead for an ink jet printing device. The printhead element includes a channel element having an array of nozzles arranged along the front face thereof and a heater element mated to the channel element. First and second butting and non-butting edges are located on either the channel element or the heater element.

Pursuant to another aspect of the present invention, there is provided a large array ink jet printhead for an ink jet printing device. The large array ink jet printhead includes a plurality of printhead elements each having an array of nozzles arranged along a front face in a substantially straight line and an array of thermal transducers, each aligned with one of the ink injecting nozzles. The printhead elements also include a first butting edge and a first non-butting edge.

An additional aspect of the invention is a method of fabricating a printhead element for a large array printhead element from a first and second wafer each having first and second opposite planar surfaces. Ink manifolds and channels are formed on the first wafer and thermal transducers, driving circuitry and logic circuitry are formed on the second wafer. Dice cuts are made on the mating surfaces of each of the wafers to define a buttable side edge and non-buttable side edge. The wafers are aligned and bonded. Back cuts are made in the second planar surfaces of each wafer and remaining portions removed to complete the printhead element.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
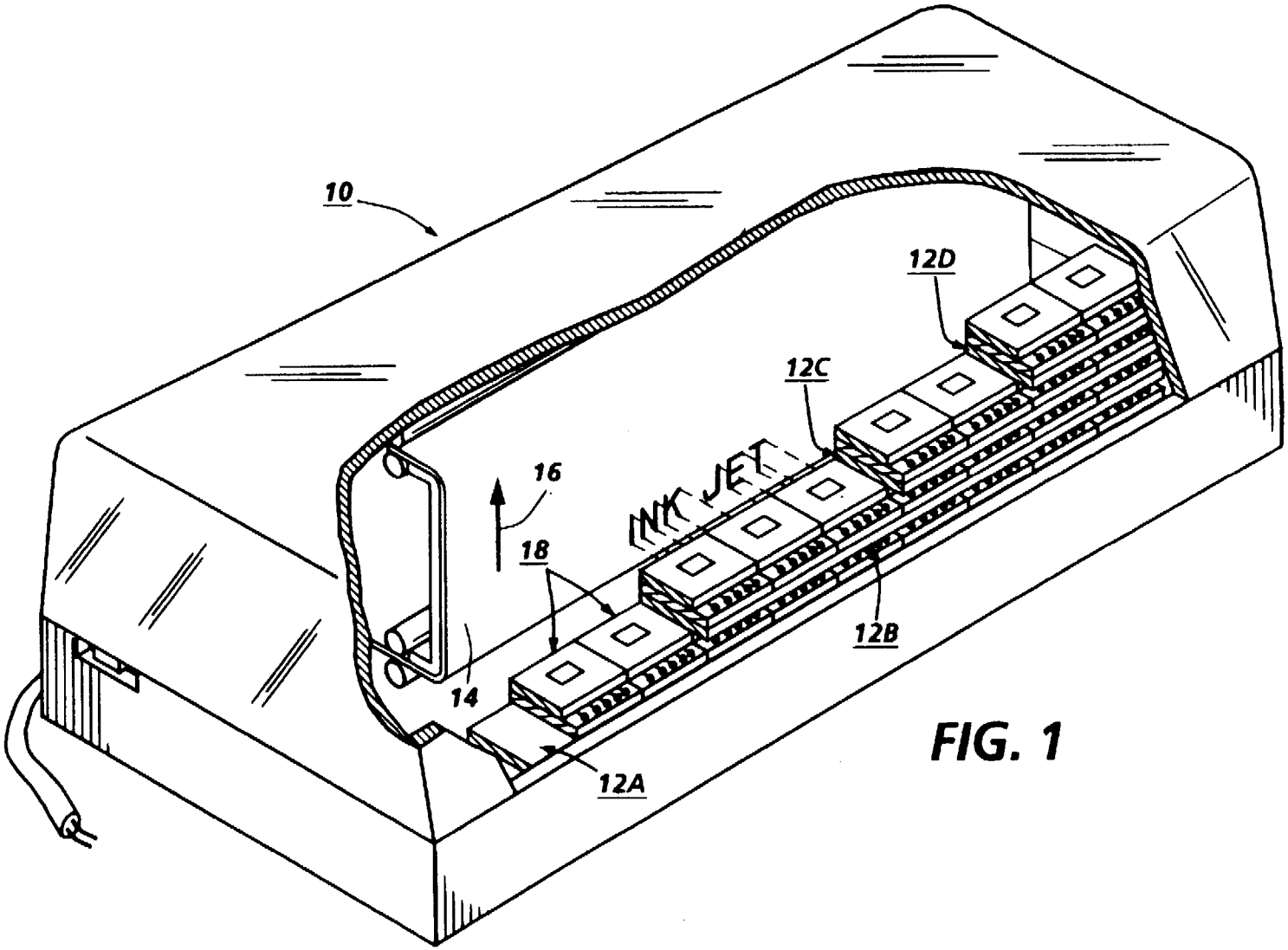
FIG. 1 is a fragmentary perspective view of a multicolor pagewidth type thermal ink jet printer having four pagewidth printbars.

FIG. 1 is a fragmentary perspective view of a pagewidth type, multicolor, thermal ink jet printer 10. In general, a pagewidth monochrome printer has a stationary printbar 12A having a length equal to or greater than the length of a sheet of paper 14. A multicolor pagewidth printer has four stationary printbars 12A, 12B, 12C, 12D stacked one over the other, with the side nozzles of each printbar in alignment with each other. The paper 14 is continually moved past the pagewidth printbars in the direction of arrow 16, a direction normal to the printbar length and at a constant speed during the printing process. Refer to U.S. Pat. Nos. 4,463,359 to Ayata et al. and 4,829,324 to Drake et al. for examples of pagewidth printing.

Figure 2:
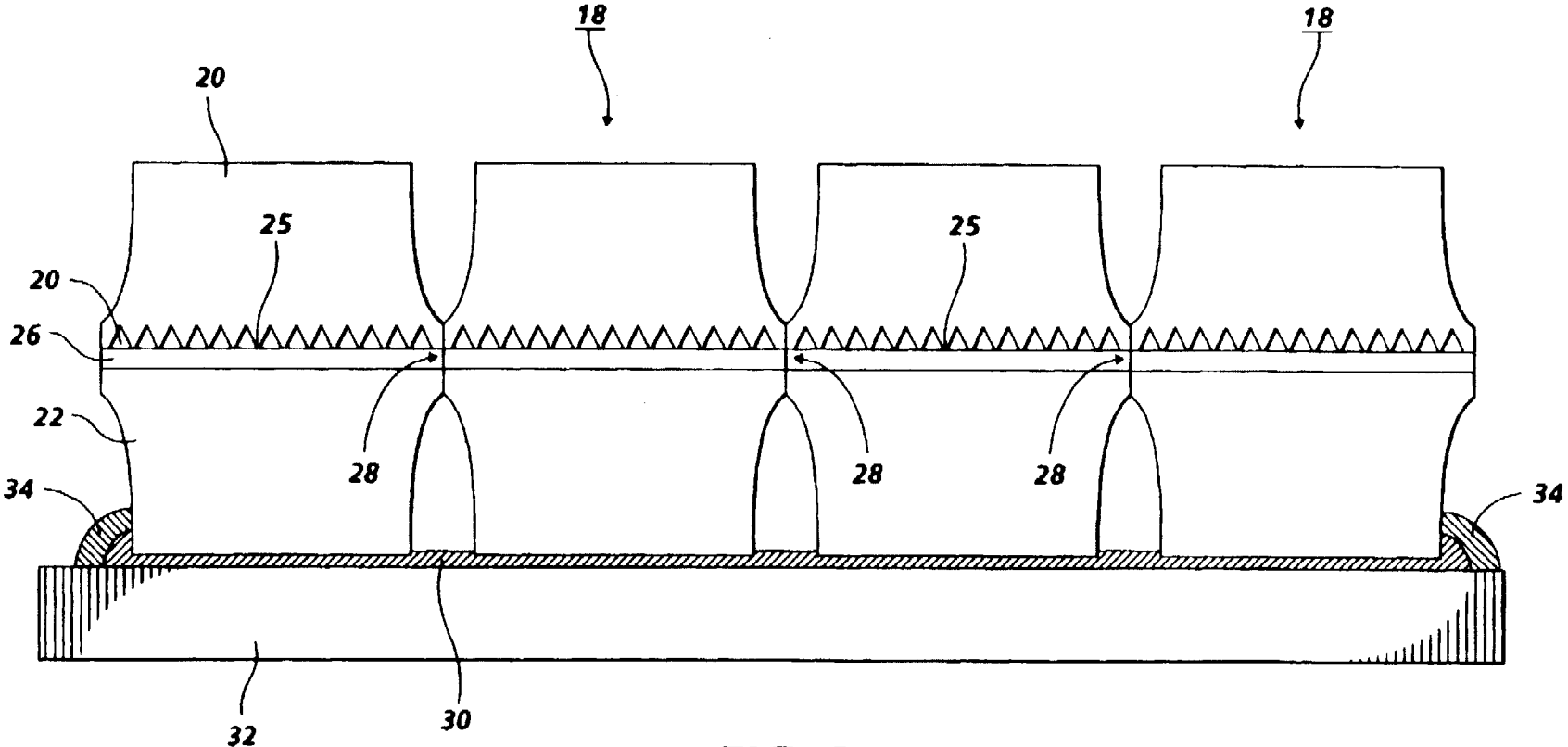
FIG. 2 PRIOR ART
FIG. 2 is a schematic elevational view of a printhead array and supporting substrate of the prior art.

A schematic elevational view of a pagewidth or large array printbar of the prior art is shown in FIG. 2. The printbar is an array of individual printhead subunits or printhead elements 18. Any known method may be used to fabricate the individual printhead subunits 18. One example is U.S. Pat. No. Re. 32,572 to Hawkins et al., incorporated herein by reference. In general, printhead elements are derived from two aligned and bonded silicon wafers, one wafer containing arrays of thermal transducers and addressing electrodes, and the other wafer containing arrays of recesses that are used as sets of channels and associated reservoirs. After bonding, the wafers are diced to form the printhead elements that combine in an array of abutted subunits to form the printbar. One of the dicing cuts is perpendicularly made across the channel opening the ends thereof to form the nozzles of the printhead elements 18. Each of the printhead elements has parallel opposing ends which are diced parallel to the channels, so that the distance between adjacent nozzles in two separately abutted printhead subunits is within the same predetermined adjacent distance as the nozzles in a single printhead subunit plus or minus the predetermined adjacent tolerance of plus or minus five micrometers. An alternative embodiment to a printbar with side nozzles is a printbar with roof nozzles. A printbar with roof nozzles is fabricated from printhead subunits having a "roofshooter" configuration. In multicolor printers, roofshooter printbars are stacked side-by-side instead of one over another. Refer to U.S. Pat. No. 4,789,425 to Drake et al. for an example of roofshooter printhead fabrication. Like printheads, subunits for reading and/or writing bars, though fabricated by any known technique, are diced to have parallel ends that are abutted to each other, so that adjacent end elements on adjacent subunits are within the same spacing as adjacent elements on a subunit, plus or minus a predetermined tolerance. Many different types of bars for reading and/or writing exist and are intended to be encompassed within this invention. The word "element" is intended to encompass any reading and/or writing subpart of a subunit making up a pagewidth reading or writing bar.

Each of the individual printheads elements 18 illustrated in FIG. 2 includes two parts, the first part being a channel element 20 and the second part being a heater element 22. The channel element 20 has a linear array of nozzles 24 located across the face of the printhead elements 18. The inner surface of the channel elements at the ends of the channel element 20 and areas 25 between nozzles 24 meets a polyimide or insulating layer 26 which is a part of the heater element 22. The polyimide layer protects electronic circuitry deposited on the surface of the heater element 22 and provides vias for ink flow as described in U.S. Pat. No. Re. 32,572 to Hawkins et al.

As illustrated, the individual printhead elements 18 are aligned in side by side relation and meet at a butting edge 28. The butting edge 28 is located on either end of the individual printhead elements 18. These edges are substantially planar and perpendicular to the linear array of nozzles 24. The butting edges 28 contact adjacent butting edges so that the individual printhead elements have some structurally rigidity when combined to form a printbar.

The butting edge 28 comprises an edge of the channel element 20 and an edge of the heater element 22. Once the individual printhead elements 18 are butted together along their respective butting edges 28, a row of individual printhead elements are aligned by known techniques and set in a thermo-setting epoxy 30 which has been placed upon a supporting substrate 32. A UV adhesive droplet 34 is located at each end of the printbar once the thermo-setting epoxy 30 is set. U.S. Pat. No. 5,221,397 to Nystrom describes the fabrication of reading or writing bar arrays assembled from subunits and is herein incorporated by reference.

Figure 3:
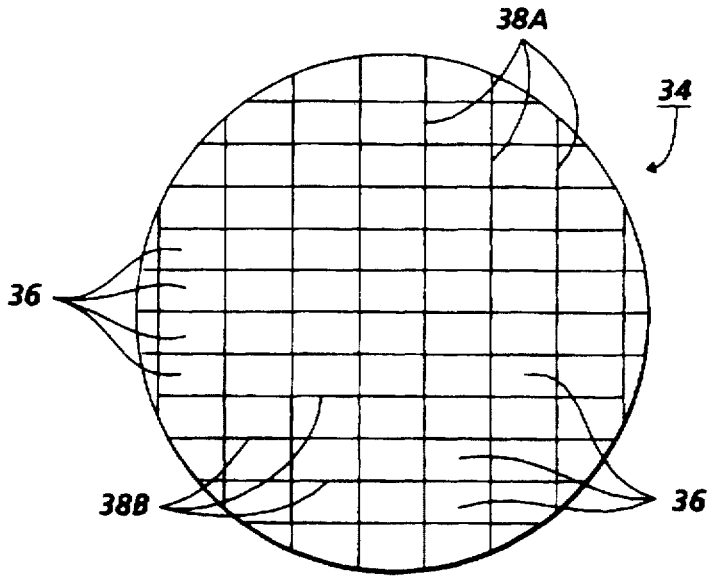
FIG. 3 is a schematic plan view of a silicon wafer having individual elements.

The butting edges 28 comprising the edge of channel element 20 and the edge of adjacent heater element 22 are made during the dicing process of a silicon wafer sandwich made of a heater element silicon wafer and a channel element silicon wafer, each wafer containing a plurality of individual heater elements 22 or channel elements 20. As shown in FIG. 3, a single silicon wafer 34 has a number of individual elements 36 which are either heater elements 22 or channel elements 20. Each of the individual elements 36 located on the wafer 34 is delineated by vertical separation lines 38A and horizontal separation lines 38B to indicate the outer edges or boundaries of each of the individual elements 36. Dicing cuts are made at the separation lines 38 to separate one element 36 from an adjacent element 36.

Figure 4:
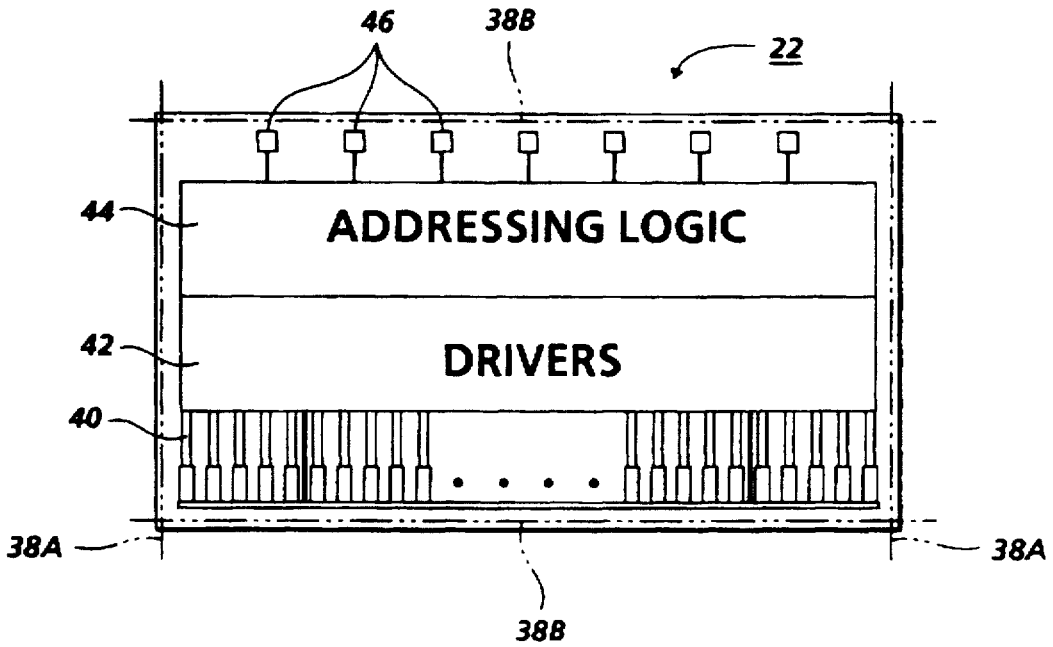
FIG. 4 is a schematic plan view of a heater element.

FIG. 4 illustrates a schematic plan view of the heater element 22. The heater element 22 includes a linear array of heaters or thermal transducers 40. The heaters or thermal transducers 40 are aligned in side by side relationship along a front edge 42 of the heater element 22. When a heater element 22 is mated to a channel element 20, each of the individual heaters 40 is associated with a respective one of the nozzles 24. The heater elements 40 are each driven individually by a driver located in a portion of the heater element here labeled driver circuitry 42. The driver circuitry is, in turn, controlled by logic circuitry 44 which activates each of the individual drivers 42 associated with a respective heater 40. The logic circuitry 44 is coupled to individual contact pads 46 which are, in turn, coupled to circuitry in the printer which generates signals to cause individual activation of each of the thermal transducers 40.

The heater elements 22 are separated along the separation lines 38 shown in FIG. 4 and previously described in FIG. 3. It is along separation lines 38A that dicing cuts are made with a dicing saw to separate individual printhead elements 22.

Figure 5:
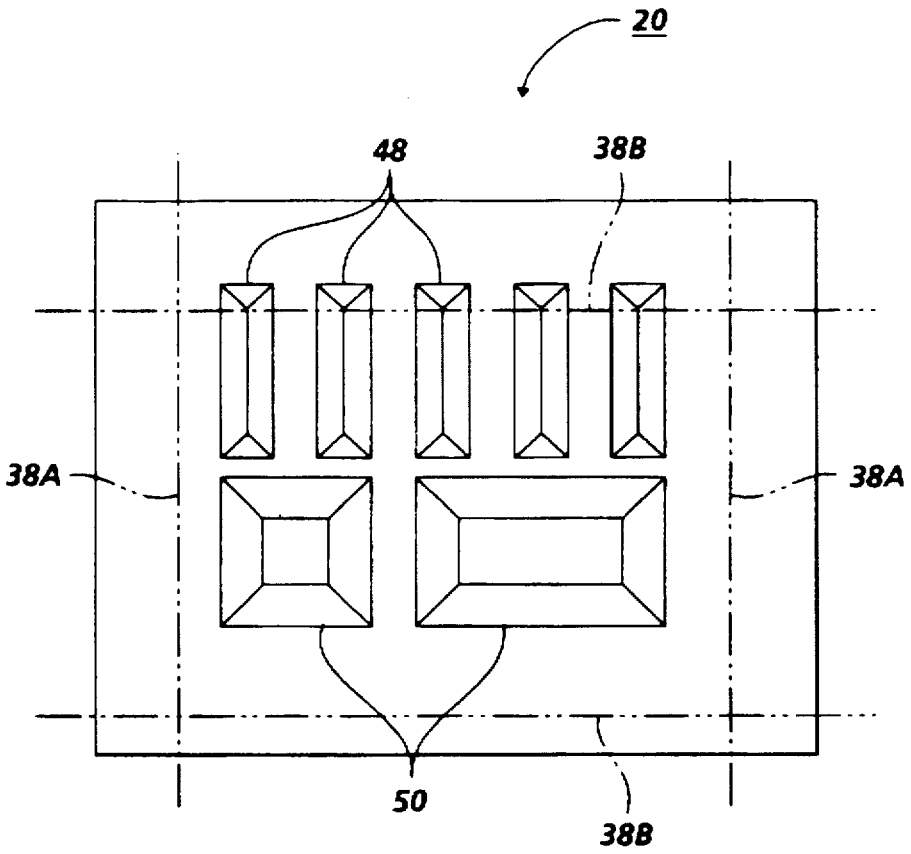
FIG. 5 is a schematic plan view of a channel element.

Likewise, as shown in FIG. 5, a channel element 20 is shown in a schematic plan view as it would appear on the wafer 34 at each of the locations 36 of FIG. 3. The channel element 20 includes a plurality of channels 48 and one or more fill holes 50. In the present embodiment, the channel wafer is etched on only one side as etching on two sides currently has a higher reject rate. The channel element 20 is also marked here with separation lines 38 along which dicing cuts are made to separate individual channel elements from other channel elements which are located adjacent thereto on the wafer 34. One of the separation lines 38B runs horizontally across each of the individual channels 48. When a cut is made at the location of the separation line 38B, the individual nozzles 24, previously shown in FIG. 2, are created.

To form the individual printhead elements 18, the silicon wafer 34 of the type shown in FIG. 3 containing individual channel elements 20 and the silicon wafer 34 of the type shown in FIG. 3 containing individual heater elements 22 are aligned, mated and bonded together with a process like that described in U.S. Pat. No. 4,678,529 to Drake et al. herein incorporated by reference. Before the alignment, however, of the heater element wafer to a channel element wafer, precision dicing cuts are made along the separation lines 38A as shown in FIGS. 3, 4 and 5. These dicing cuts are made to the surface of the individual wafers with a precision dicing saw which cuts a dice line of approximately 25–50 microns wide and 125–250 microns deep. U.S. Pat. No. 5,160,403 to Fisher et al. describes such a dicing operation and is herein incorporated by reference. The dicing cuts made at the separation lines 38A which run along the side edges of the heater element 22 parallel to the thermal transducers 40 and the separation lines 38A where dicing cuts are made which run parallel to the channels 48 on the channel element 20 define the butting edge 28 of the individual printhead elements 18 shown in FIG. 2.

After the dice cuts are made along the separation lines 38, the heating element wafer is aligned, mated and bonded to a channel element wafer so that the horizontal and vertical dicing cuts formed on the interior surfaces of each of the respective wafers are aligned with respect to one another. Once the wafers are aligned, mated and bonded then back cuts are made on the exposed sides of the wafers down to the dice cuts. These back cuts are wider than the dice cuts and provide for separation of individual printhead elements from the two wafer sandwich comprising the heater element and the channel wafers. Once separated each of the printhead elements 18 includes the butting edge 28 as shown in FIG. 2.

As can be seen in FIG. 2, the butting edge 28 must be perfectly flat across the diced edge of the channel element and the diced edge heater element. To create such a flat edge, the dice cuts previously cut on the mated surfaces of each of the wafers must not only have been cut essentially perpendicular to the flat surface of the wafer but also must have been cut with the same width. If either the dice cuts to the channel elements or the dice cuts to the heater elements are improperly made, the butting edge does not provide a proper butting surface. Even if the dice cuts are perfectly made, if the channel wafer is not properly aligned to the heater wafer, then the precision dice cuts of the channel wafer to the heater wafer do not meet and the surface relied upon as butting edge 28 is imperfect. Consequently, in the prior art the precision butting of individual printheads 18 relied upon an accurate dice cut to the channel element, an accurate dice cut to the heater element, and proper alignment of the channel element wafer to the heater element wafer to create a flat butting edge from one element to another. As can be seen, each step must be performed accurately to prevent any butting errors between adjacent printhead elements 18.

The present invention contemplates a solution to butting errors which occur between individual printhead elements due to these problems. It is, therefore, proposed that either the channel element or the heater element is the primary and only butting member by shortening the width dimensions of the other butting member so that any butting error is a function of only one or the other member, but not both. More control of butting errors is possible if only one of the individual elements, either the heater element or the channel element, participates in the butting process.

If only one of the elements is used as the butting member, a gap or space having substantially parallel sides appears between the diced edges of the other elements. For instance, if the heater plate is used as the butting member, a gap appears between adjacent channel elements.

Using the heater elements as the butting member is a preferred embodiment since the channel element is structurally less robust than the heater element. In addition, the heater element needs to be as wide as possible to maximize the thickness of the polyimide end walls which are adjacent to the end heaters located at either end of the heater element array. If, however, the channel element is chosen to be the butting member, a gap appears between each of the individual heater elements. This gap provides for a thermal expansion gap between adjacent heater transducer elements when mated in a collinear thermal ink jet printbar. These gaps reduce or eliminate the possibility of heater chip damage due to thermally generated compressive forces between adjacent heater chips. The method provides these gaps without abandoning the die butting concept by using the channel elements as the butting member while the heater element is of a slightly smaller width. Thus, the heater elements never physically touch and any damaging thermally compressive forces are never applied to the sensitive heater element.

Figure 6:
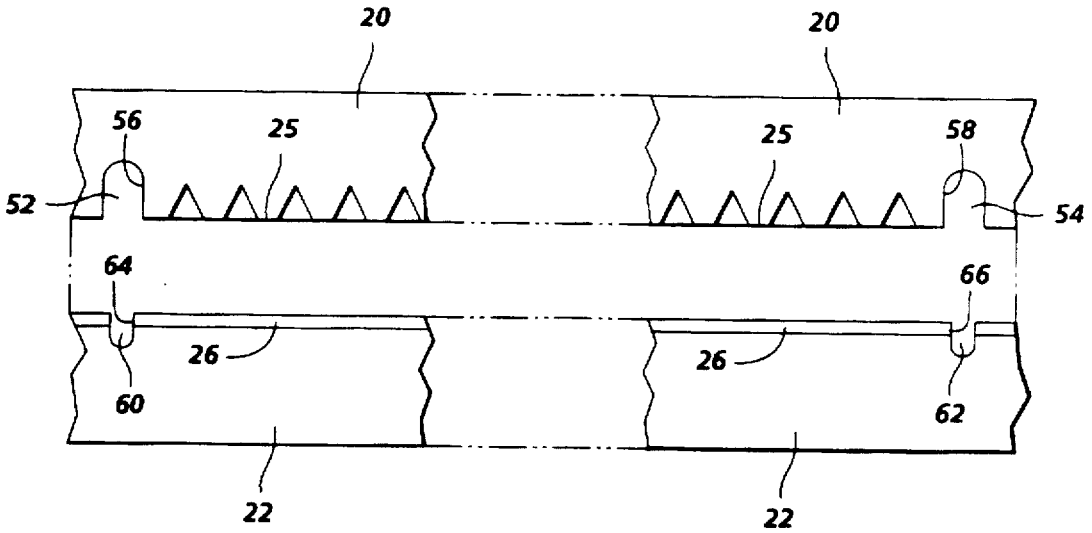
FIG. 6 is a schematic fragmentary elevational view of a channel element wafer and heater element wafer having dice cuts before mating.

FIG. 6 is a schematic fragmentary elevational view of a heater element wafer and a channel element wafer prior to mating showing the vertical dicing cuts made along the separation lines 38A of the present invention. The channel element 20 has a wide dicing cut 52 and 54 made at opposite sides of the channel element running parallel to the individual channels 48. Each wide dicing cut 52 and 54 creates a first non-butting edge 56 and a second non-butting edge 58 whose significance will become apparent in FIG. 7.

Likewise, the heater element 22 has dicing cuts made along the separation lines 38. In this case, however, narrow dicing cuts 60 and 62 are made along the separation lines 38A which are parallel to the individual thermal transducers 40. Each of these dicing cuts is narrower than respective adjacent wide dicing cuts 52 and 54. Wide dicing cuts can be made by a dicing saw having a blade wider than the saw used for the narrow dicing cuts or can be made by two passes of the saw used for the narrow dicing cuts. As shown, each of the dicing cuts 52, 54, 60 and 62 are centered on the separation lines 38. The narrow dicing cuts 60 and 62 form a first butting edge 64 and a second butting edge 66. The narrow dicing cuts create a heater element which has an overall width which is slightly greater than the corresponding channel element. Consequently, the first butting edge 64 and second butting edge 66 lie outside the first non-butting edge 56 and the second non-butting edge 58. Narrow dicing cuts and wide dicing cuts do not need to be centered over each other. It is only essential that the placement of the dicing cuts creates a butting edge and non-butting edge offset from one another in a horizontal direction so that only one butting surface is created.

Figure 7:
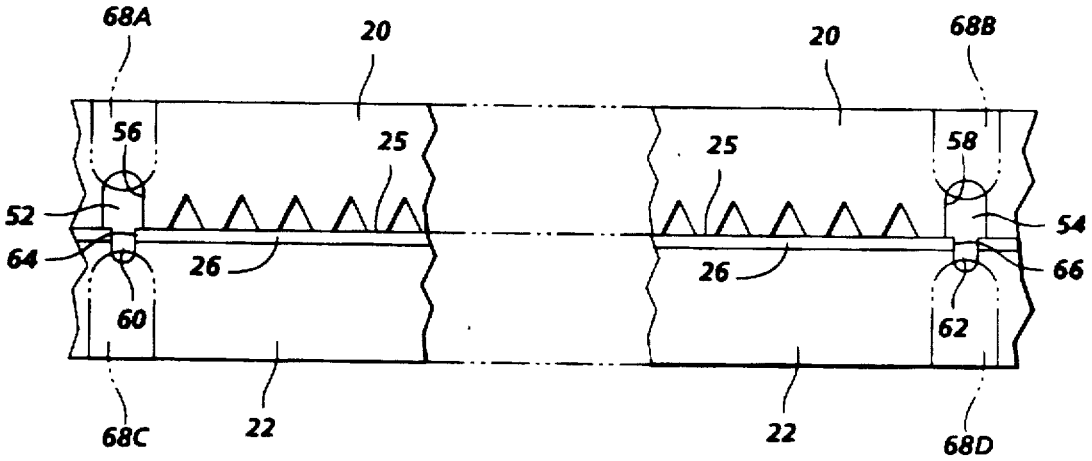
FIG. 7 is a schematic fragmentary elevational view of a channel element wafer bonded to a heater wafer having dice cuts and back cuts.

As shown in FIG. 7, once the channel element wafer has been aligned, mated and bonded to the heater element wafer, the wide dicing cut 52 and the narrow dicing cut 60 are adjacent as are the wide dicing cut 54 and the narrow dicing cut 62. To create the individual printhead elements 18 additional cuts must be made to the exposed surfaces of the wafers which will intersect the previously made dicing cuts. Each of the dicing cuts 52, 54, 60 and 62 have a back cut 68A, 68B, 68C and 68D made of a sufficient depth to intersect a respective dicing cut so that the individual printhead elements can be separated from adjacent columns of printhead elements, the columns defined by separation lines 38A. Once the back cuts 68A–68D have been made, the individual printhead elements are further separated from adjacent printhead elements in a column of printhead elements by cutting along the front and back edges of each of the printhead elements along separation lines 38B. In this way, an individual printhead element 18 is formed having only a first and second butting edge 64 and 66 which will be used as the butting surfaces for mating with adjacent printhead elements 18 once constructed into a printbar 12.

Figure 8:
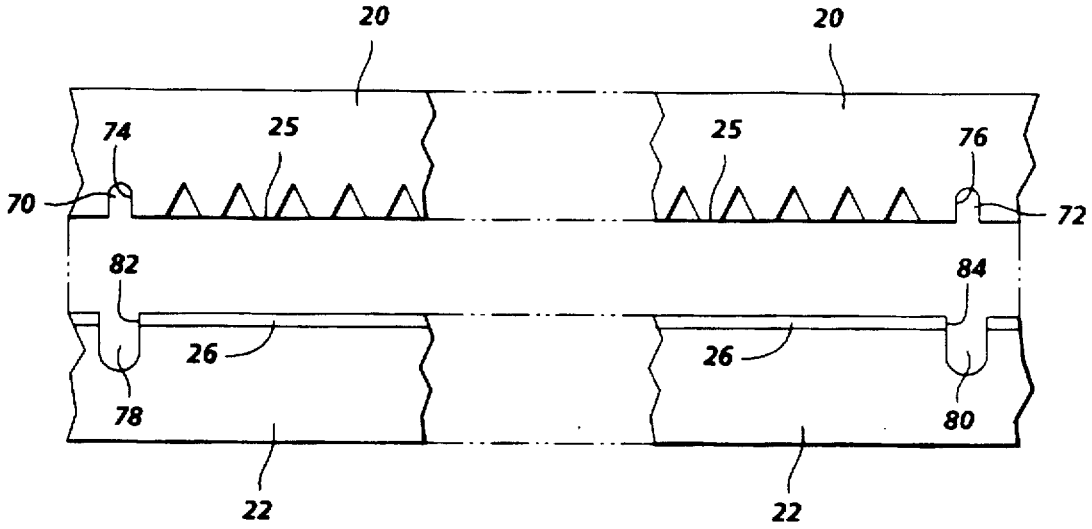
FIG. 8 is a schematic fragmentary elevational view of a channel element wafer and heater element wafer having dice cuts before mating.
Figure 9:
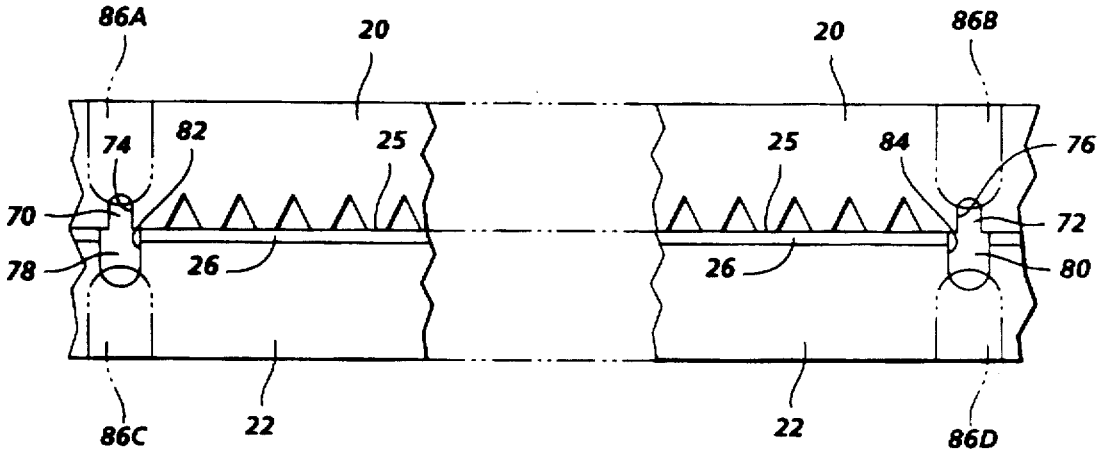
FIG. 9 is a schematic fragmentary elevational view of a channel element wafer bonded to a heater element wafer having dice cuts and back cuts.

FIGS. 8 and 9 illustrate the fabrication of printhead elements 18 which have butting edges formed in the channel element 20. As shown in FIG. 8, the channel element 20 is diced with a narrow dicing cut 70 and a narrow dicing cut 72 along the separation lines 38A which are parallel to the individual channels 48. The narrow dicing cut 70 creates a first butting edge 74 and the narrow dicing cut 72 creates a second butting edge 76. Likewise, the heater element wafer having individual heater elements 22 is diced with a wide dicing cut 78 and a wide dicing cut 80 along the separation lines 38. Each of the wide dicing cuts 78 and 80 create respectively a first non-butting edge 82 and a second non-butting edge 84. By forming the narrow dicing cuts and widened dicing cuts as described, the channel element has a width slightly larger than the heater element so that the butting edge is formed on the channel element as opposed to being formed on the heater element as has been previously described in FIGS. 6 and 7. Once the dicing cuts are made, the channel element wafer and the heater element wafers are aligned, mated and bonded together as shown in FIG. 9. It can be seen that the narrow dicing cut 70 is centered over the wide dicing cut 78 and the narrow dicing cut 72 is centered over the wide dicing cut 80. Individual printhead elements are then created by making back cuts 86A–86D through each of the respective dice cuts as previously described and further separation techniques.

Figure 10:
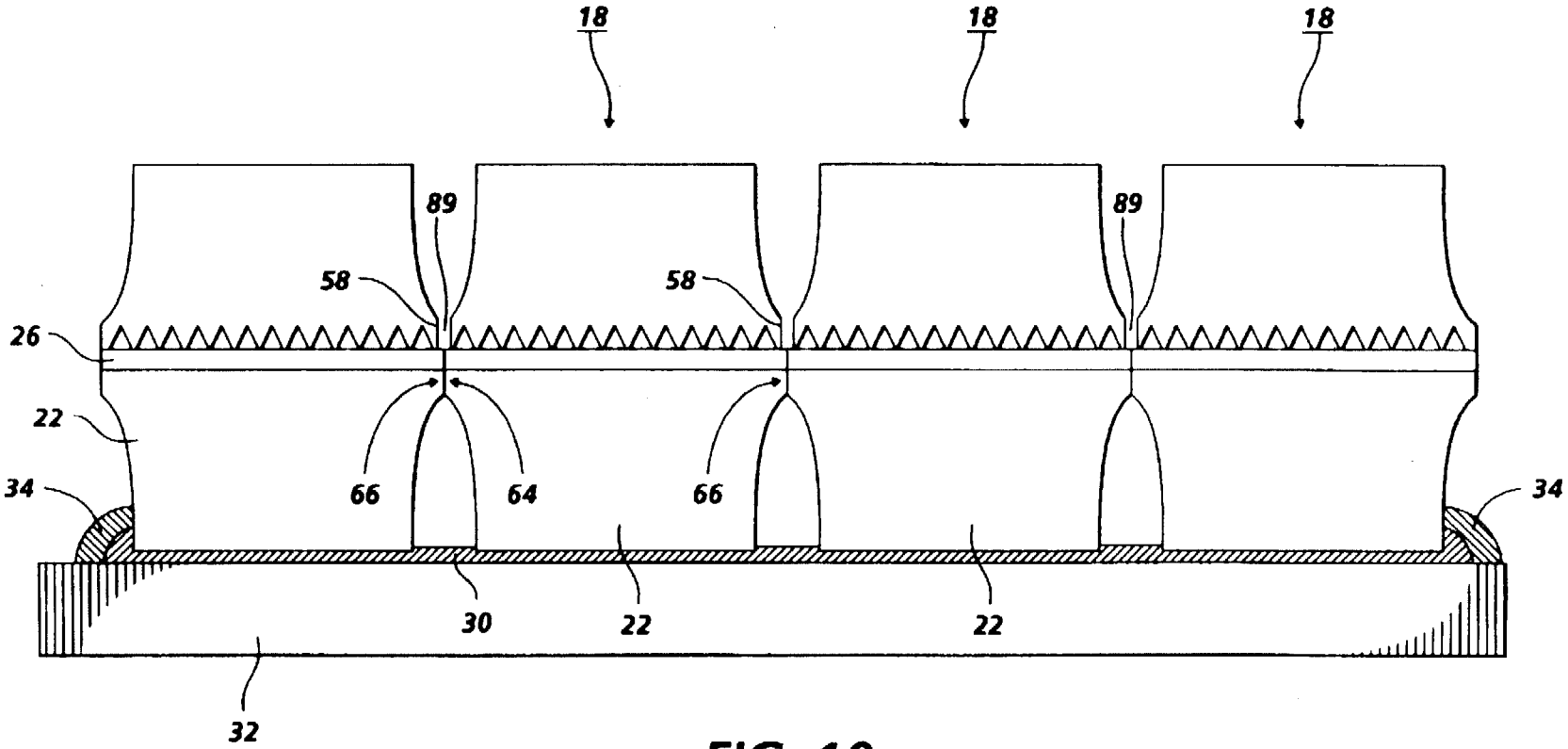
FIG. 10 is a schematic elevational view of a printhead array and supporting substrate having printhead element butting edges at the heater elements.

Once individual printheads have been formed by the dicing cuts and back cuts, as illustrated in FIGS. 7–9, a large array printhead can be fabricated. FIG. 10 is a schematic elevational view of a printbar comprised of individual printhead elements 18 having butting edges formed on the heater elements 22 from the process described in FIGS. 6 and 7. The large array printbar 12 is fabricated as previously described by aligning and mating individual printhead elements 18 end to end and placing the array of printhead elements in the thermal setting epoxy 30 which has been placed upon the supporting substrate 32. Once in place, a drop of UV adhesive 34 is deposited at either end of the large array of printhead elements. Each printhead element has first and second butting edges 64 and 66 and first and second non-butting edges 56 and 58. By relying on the individual heater elements to provide a butting edge, the process for making a large array printbar can be more accurately controlled since it is not necessary that the outer edge of the channel elements comprising the printhead arrays elements be flush with the related edge of the heater elements mated thereto. By using the edges of the heater elements, as the butting edges, a more robust and accurately aligned large array printbar element is possible. A gap 89 appears between adjacent channel elements 20.

Figure 11:
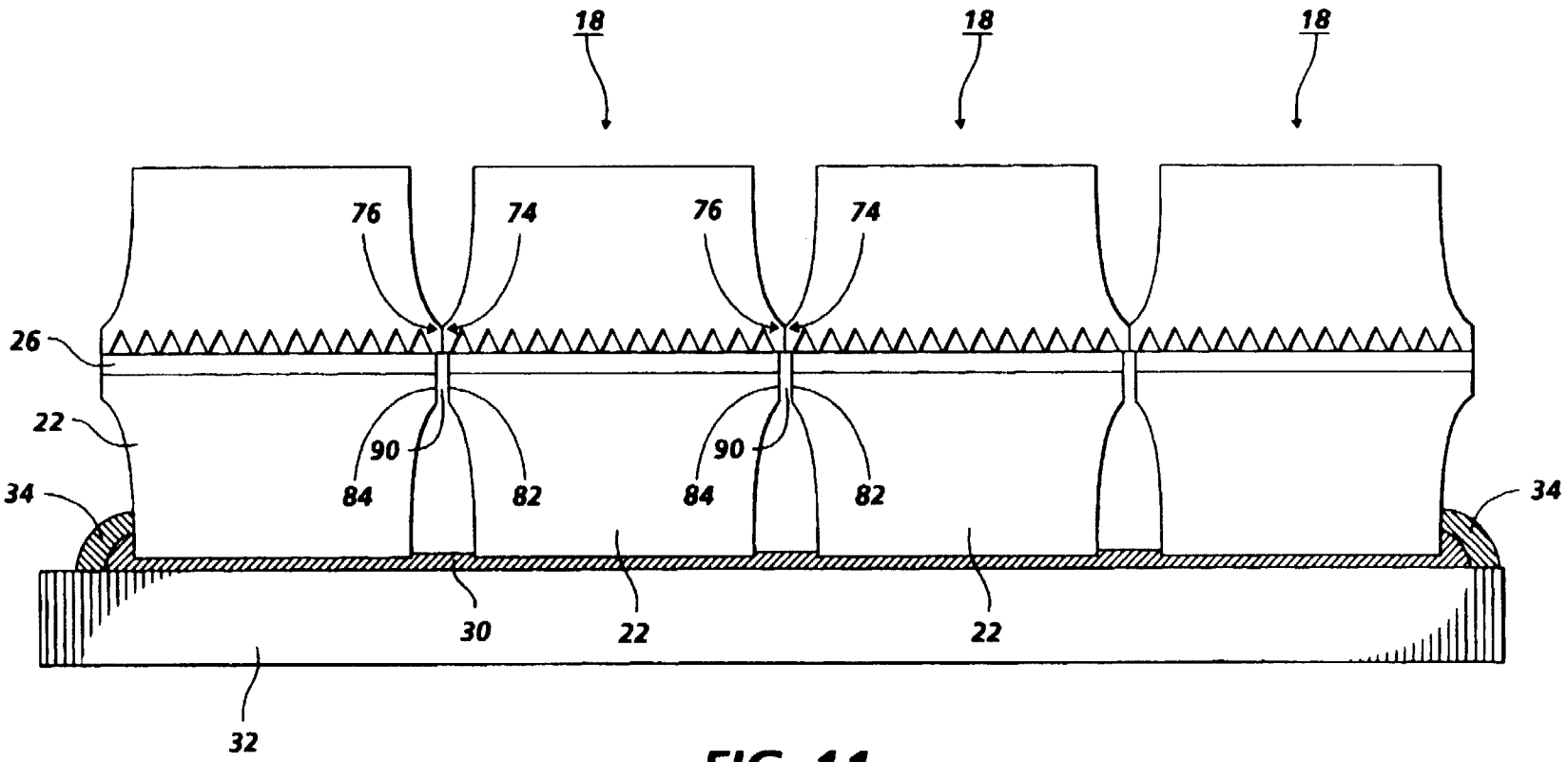
FIG. 11 is a schematic elevational view of a printhead array and supporting substrate having printhead element butting edges at the channel elements.

FIG. 11 illustrates a schematic elevational view of a large array printbar using individual printhead elements 18 having a butting edge on the channel elements comprising each of the individual elements. As illustrated in FIG. 11, the individual printhead elements 18 are again mated and aligned with other printhead elements 18 to form a large array printbar. After mating and alignment, the printhead elements 18 are placed on the thermo-setting epoxy 30 layed upon the supporting substrate 32. Once the thermo-setting epoxy has set, the UV adhesive droplet 34 is placed at either end of the printhead array.

As can be seen in FIG. 11, this particular embodiment of the present invention uses the channel elements as the butting edges for forming the printhead array. Since the channel elements are used as the butting edges, the non-butting edges which are offset from the butting edges form a gap 90 between heater elements of adjacent printhead elements. While the butting edges of a channel element are currently, not as durable or as strong as those of a heater element, the embodiment of FIG. 11 has an advantage over the previously described array. The gap 90 which appears between the individual heater elements provides an air gap to provide a means for cooling off or preventing any thermal conductivity between adjacent heater elements and their respective heaters. While the channel plate is structurally less robust than the heater plate, this embodiment creates a gap between adjacent heater elements to thereby provide for thermal expansion between the heater elements in a collinear thermal ink jet printbar. These gaps could reduce or eliminate the possibility of heater element damage due to thermally generated compressive forces which might occur between heater element.

The method of providing butting and non-butting surfaces between adjacent heater elements or adjacent channel elements allows the continued use of die butting concepts where channel elements and heater elements are separated by dicing cuts along channels and thermal transducers to create a large array thermal ink jet printhead. It is desirable to use this sub-unit approach because it is difficult to form a unitary monolithic printhead having a length corresponding to the width of a page. Monolithic printheads having the length of a page width are also non-preferred because one defective channel or thermal transducer out of the numerous channels or thermal transducers which would appear across the monolithic printhead would render the entire printhead useless. Consequently, in the sub-unit approach, each individual printhead element can be tested prior to assembly and thus only acceptable elements are used to create a large array printhead. By using a die butting concept which uses only adjacent heater elements or adjacent channel elements as the butting edges, a more reliable and consistent method of producing large array printheads is created.

It is, therefore, apparent that there has been provided in accordance with the present invention, a printhead element having butting and non-butting surfaces and/or a method for fabricating printhead elements having fewer butting surfaces to form large array printheads that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A method of fabricating a printhead element having buttable side edges and non-buttable side edges for a large array printhead from a first wafer having first and second opposite planar surfaces and a second wafer having first and second opposite planar surfaces, comprising the steps of:

forming ink manifolds and a linear array of channels on the first planar surface of the first wafer;

forming a linear array of thermal transducers, driving circuitry, and logic circuitry on the first planar surface of the second wafer;

placing a first dice cut and a second dice cut through the first planar surface of the first wafer adjacent to and parallel with the linear array of channels, the first dice cut and the second dice cut defining buttable side edges separated by a distance and extending partially through the first wafer;

placing a first dice cut and a second dice cut through the first planar surface of the second wafer adjacent to and parallel with the linear array of thermal transducers, the first dice cut and the second dice cut defining non-buttable side edges separated by a distance less than the distance between the buttable side edges and extending partially through the second wafer;

aligning and bonding the first planar surface of the first wafer to the first planar surface of the second wafer;

placing back cuts through the second planar surface of the first wafer to a depth sufficient to intersect the first dice cut and the second dice cut of the first wafer and through the second wafer to a depth sufficient to intersect the first dice cut and the second dice cut of the second wafer; and removing remaining portions of the first wafer and second wafer to fabricate the printhead element.

2. A method of fabricating a printhead element from a first wafer having a first surface and a second surface and a second wafer having a first surface and a second surface comprising:

forming an array of channels on the first surface of the first wafer;

forming an array of thermal transducers on the first surface of the second wafer;

placing a first dice cut and a second dice cut through the first surface of the first wafer adjacent to the array of channels, the first dice cut and the second dice cut defining side edges separated by a first distance and extending partially through the first wafer;

placing a third dice cut and a fourth dice cut through the first surface of the second wafer adjacent to the array of thermal transducers, the third dice cut and the fourth dice cut defining side edges, separated by a second distance different than the first distance, and extending partially through the second wafer;

mating the first surface of the first wafer to the first surface of the second wafer;

placing a back cut through the second surface of the first wafer to intersect the first dice cut and a back cut through the second surface of the second wafer to intersect the third dice cut; and removing remaining portions of the first wafer and second wafer to complete the printhead element.

3. The method of claim 2, further comprising placing a back cut through the second surface of the first wafer to intersect the second dice cut and a back cut through the second surface of the second wafer to intersect the fourth dice cut.

4. The method of claim 3, wherein said first mentioned placing step comprises placing the first dice cut and the second dice cut through the first surface of the first wafer to define buttable side edges separated by the first distance being greater than the second distance.

5. The method of claim 4, wherein said second mentioned placing step comprises placing a third dice cut having a width greater than a width of the first dice cut and a fourth dice cut having a width greater than a width of the second dice cut to define non-buttable side edges separated by the second distance.

6. The method of claim 4, wherein said second mentioned placing step comprises placing the third dice cut and the fourth dice cut through the first surface of the second wafer to define non-buttable side edges separated by the second distance being less than the first distance.

7. The method of claim 3, wherein said first mentioned placing step comprises placing the first dice cut and the second dice cut through the first surface of the first wafer to define non-buttable side edges separated by the first distance being less than the second distance.

8. The method of claim 7, wherein said first mentioned placing step comprises placing a first dice cut having a width greater than a width of the third dice cut and a second dice cut having a width greater than a width of the fourth dice cut to define non-buttable side edges separated by the first distance.

9. The method of claim 8, wherein said second mentioned placing step comprises placing the third dice cut and the fourth dice cut through the first surface of the second wafer to define buttable side edges separated by a distance greater than the first distance.

* * * * *